US006460207B1

(12) United States Patent
Papay et al.

(10) Patent No.: US 6,460,207 B1
(45) Date of Patent: Oct. 8, 2002

(54) ANTI-SIDS PEDIATRIC HEADREST

(75) Inventors: Frank A. Papay, Westlake; Bryan P. Byerman, South Euclid; Paul Tamulewicz, Cleveland, all of OH (US)

(73) Assignees: Cleveland Clinic Foundation, Cleveland, OH (US); Team Wendy, Cleveland, OH (US)

( * ) Notice: Subject to any disclaimer, the term of this patent is extended or adjusted under 35 U.S.C. 154(b) by 0 days.

(21) Appl. No.: 09/417,352

(22) Filed: Oct. 13, 1999

Related U.S. Application Data

(60) Provisional application No. 60/103,947, filed on Oct. 13, 1998.

(51) Int. Cl.[7] ..... A47G 9/00; A61G 13/12

(52) U.S. Cl. ..... 5/640; 5/603; 5/622; 5/643; 5/637

(58) Field of Search ..... 5/640, 643, 603, 5/622, 637, 636, 655; 128/869, 846

(56) References Cited

U.S. PATENT DOCUMENTS 622,501 A * 4/1899 Larrabee ..... 5/643
933,471 A * 9/1909 Leahy ..... 5/637
2,239,003 A * 4/1941 Jones ..... 5/640
2,671,442 A * 3/1954 Cameto ..... 5/622
3,337,883 A * 8/1967 Allison ..... 5/643
4,771,493 A * 9/1988 Park ..... 5/643
4,805,603 A * 2/1989 Cumberland ..... 5/640
4,825,487 A * 5/1989 Eberl ..... 5/603
5,007,122 A * 4/1991 Daughdrill ..... 5/637
6,052,849 A * 4/2000 Dixon et al. ..... 5/655

* cited by examiner

*Primary Examiner*—Alexander Grosz
(74) *Attorney, Agent, or Firm*—Tarolli, Sundheim, Covell, Tummino & Szabo L.L.P.

(57) ABSTRACT

The invention provides a headrest assembly for supporting the head of a child comprising a cradle mounted in a support base. The cradle may be pivotally mounted within the support base with spring loaded joints. The cradle has a first contoured section for receiving the neck of the child, and a second curved section with curved sidewalls extending therefrom and for receiving the head of the child. The assembly may also comprise a shoulder and upper back support assembly which is comprised of a soft compressible material which is contoured and shaped to provide comfort and upper back support to a child.

9 Claims, 16 Drawing Sheets

ANTI-SIDS PEDIATRIC HEADREST

PRIORITY CLAIM

This application claims the benefit of U.S. provisional patent application No. 60/103,947 filed on Oct. 13, 1998, the entirety of which is hereby incorporated by reference.

FIELD OF THE INVENTION

The invention relates generally to headrests and more particularly to pediatric headrests.

BACKGROUND OF THE INVENTION

The leading cause of death among infants is the Sudden Infant Death Syndrome (SIDS). It is currently believed that ensuring sufficient airflow around the child's nose and mouth may help reduce the risk of SIDS. In addition, epidemiological data indicates that babies that sleep on their stomachs have an increased risk of SIDS. Thus it is currently recommended that babies sleep on their backs (supine position) in order to reduce the risk of SIDS. One disadvantage to this approach is that if the child refluxes its stomach contents, the child may not be able to expel his own contents out and may potentially aspirate it into the lungs or onto the vocal chords causing a vocal spasm. Another disadvantage to this approach is if the child were to roll onto its stomach, the child could potentially suffocate due to the blockage of its oral and nasal airway. Since most children less than one year old are obligate nasal breathers, it is of paramount importance to allow a clear nasal airway.

Another prior art approach to reducing the risk of SIDS is the use of wedges to promote the child to sleep on its side. One disadvantage to this approach is that side sleeping has a higher risk of SIDS than the supine position. Another disadvantage is that improper use of the wedge may encourage the child to roll onto its stomach.

Another prior art approach to reducing the risk of SIDS is through the use of a forced air ventilated mattress. One disadvantage to this approach is that it does not prevent the child from rolling over onto its stomach. Another disadvantage to this approach is that the child is at risk if it regurgitates its stomach contents. A further disadvantage to this approach is that the child's head may deform (positional plagiocephaly), i.e., form a flat spot from sleeping on its back on a flat surface.

Thus it is desired to have an improved ANTI-SIDS device which keeps the child's head in an elevated supine position as well as provide a surface which prevents the malformation of the child's head. It is further desired to provide a device which provides a supply of humidified air or oxygen to the area about the child's nose as well as provide a motion sensor or pulse meter and alarm system to alert an adult if the child has momentarily stopped breathing.

SUMMARY OF THE INVENTION

The invention provides a novel lightweight and portable anti-SIDS headrest for use with a stroller, carseat or child bed assembly. The invention provides in one aspect a headrest assembly for supporting the head of a child, the assembly comprising a cradle mounted in a support base; the cradle having a first contoured section for receiving the neck of the child, and a second curved section with curved sidewalls extending therefrom and for receiving the head of the child.

The invention provides in another aspect a headrest assembly for supporting the head of a child, the assembly comprising: a cradle having a first contoured section for receiving the neck of the child, and a second curved section with curved sidewalls extending therefrom for cupping the head of the child. The assembly further comprises a shoulder and upper back support section integrally formed with the cradle and having an angled contoured surface.

These and other aspects of the invention are herein described in detail with reference to the accompanying Figures.

DETAILED DESCRIPTION OF THE PREFERRED AND ALTERNATE EMBODIMENTS

Figure 1:
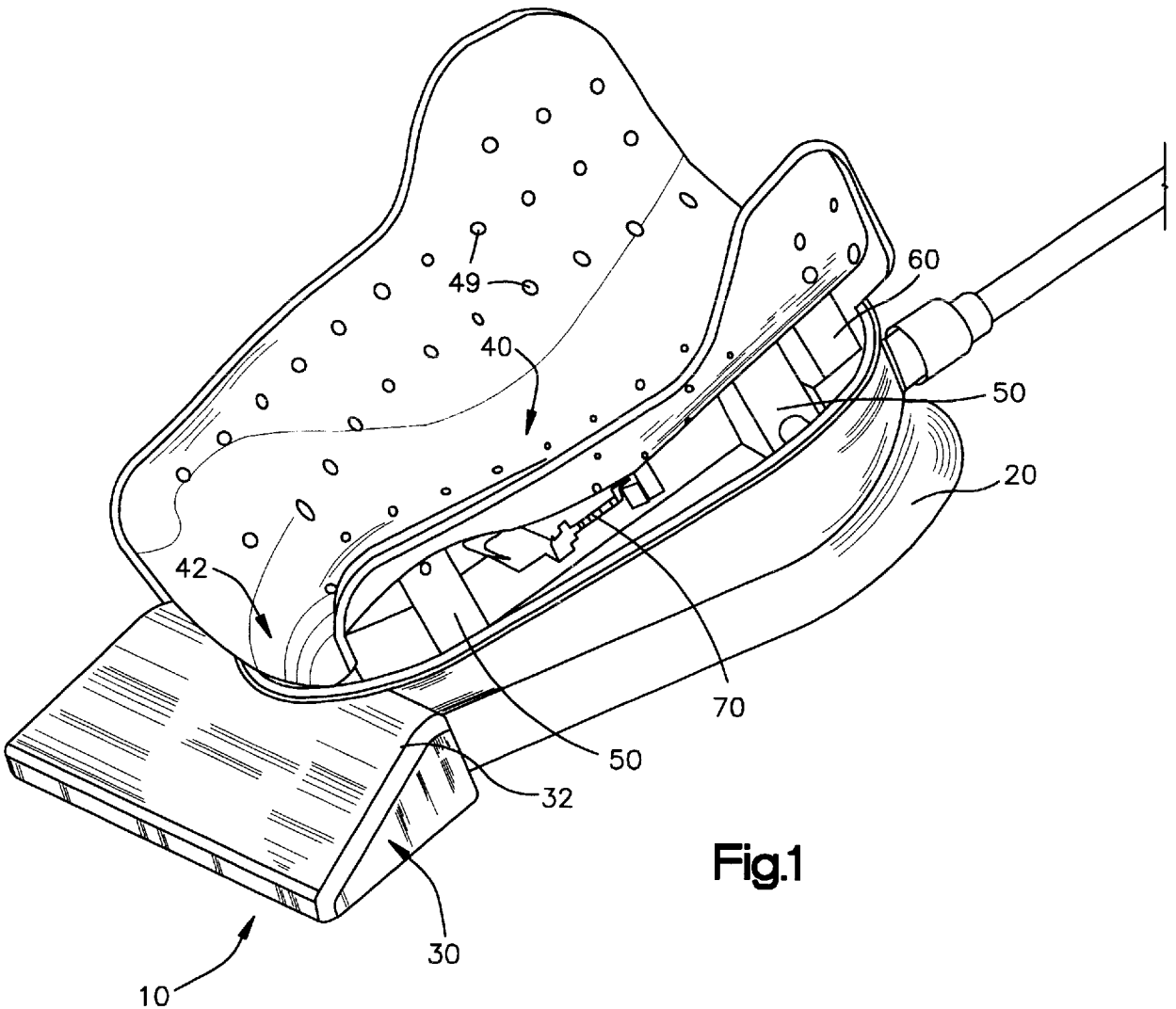
FIG. 1 is a perspective view of the anti-SIDS pediatric headrest assembly of the present invention.
Figure 2:
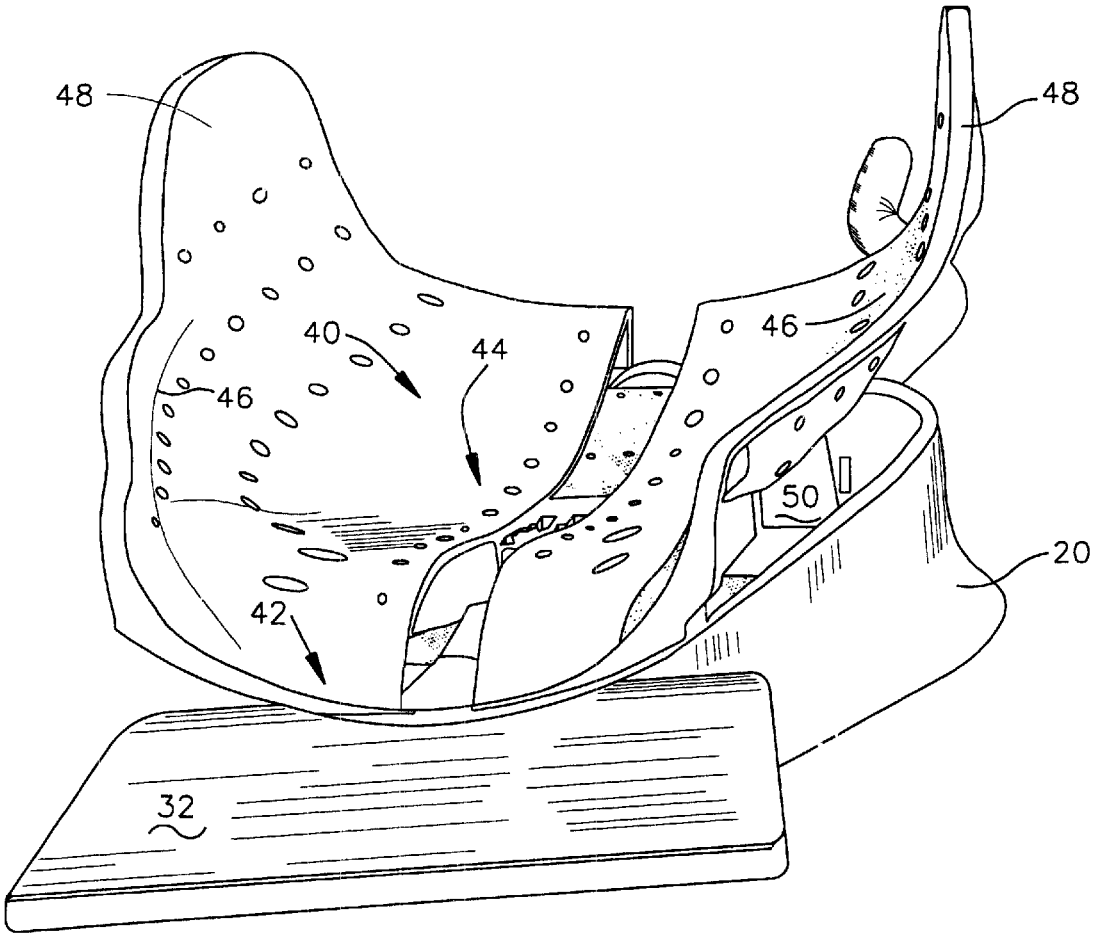
FIG. 2 is a front perspective view of the headrest of the invention as shown in FIG. 1 with the cradle in a partially expanded position.
Figure 3:
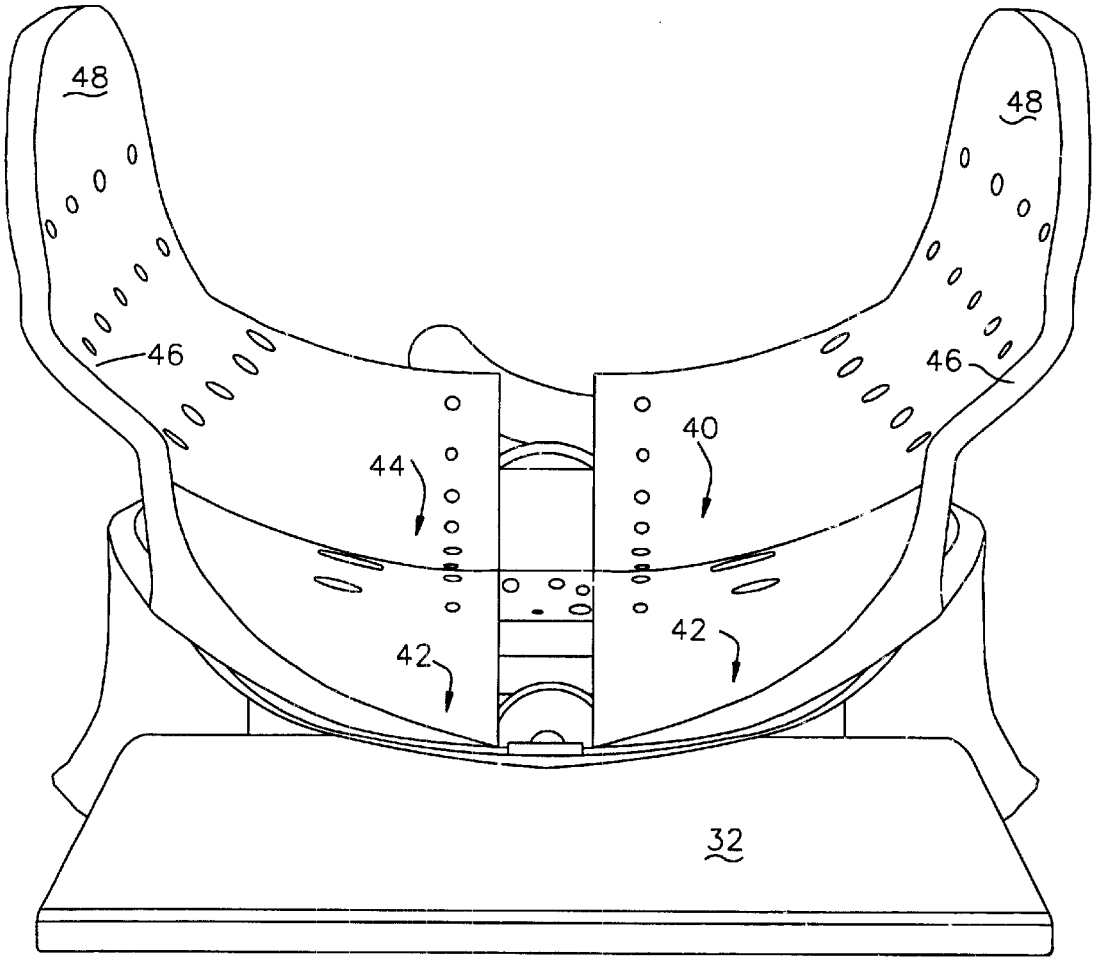
FIG. 3 is a front elevational view of the pediatric headrest of the invention as shown in FIG. 1 with the cradle in a partially expanded position.
Figure 4:
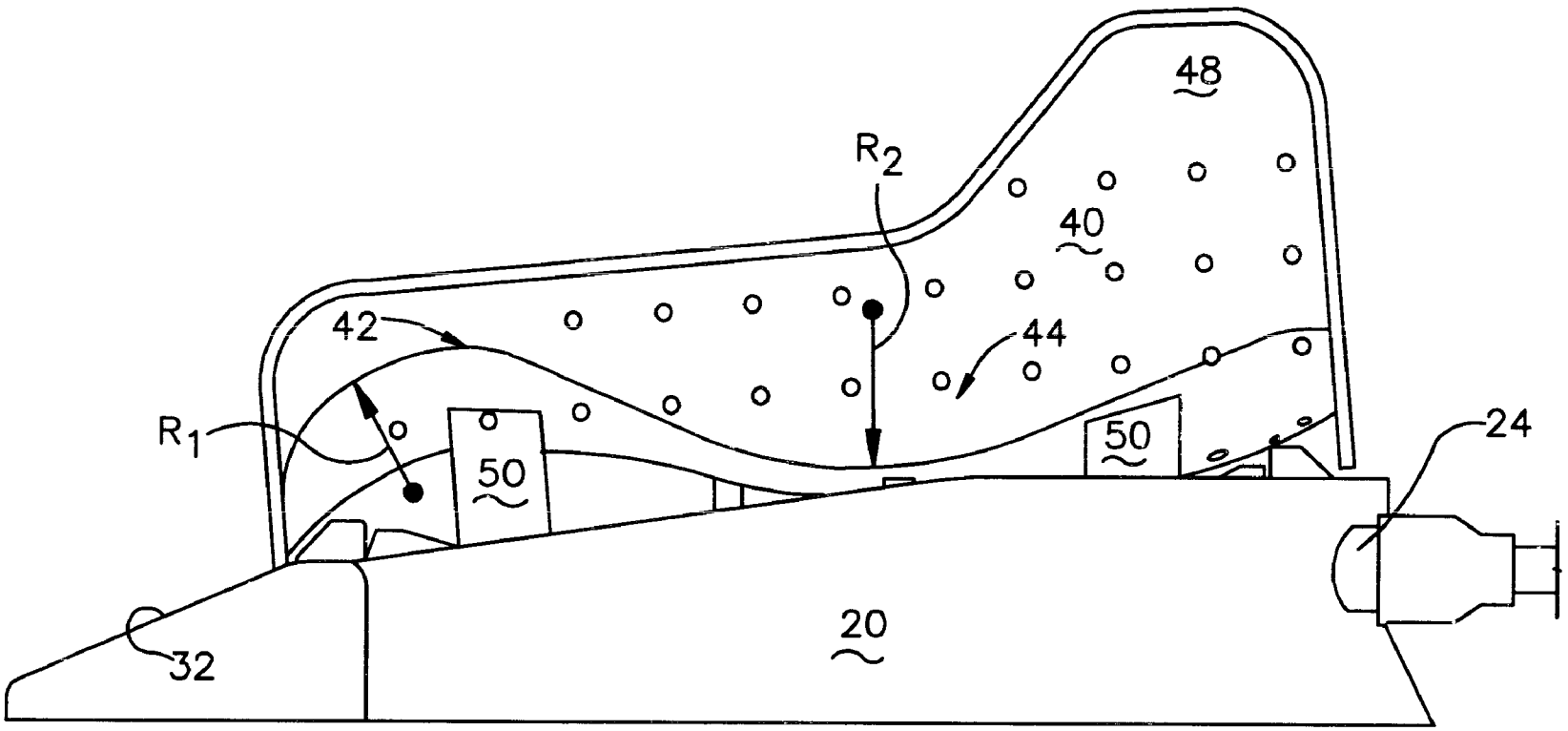
FIG. 4 is a side elevational view of the pediatric headrest of the invention as shown in FIG. 1.

As shown in detail in FIGS. 1–8, the invention provides a first embodiment of a pediatric headrest assembly 10 for supporting and slightly elevating the head of a pediatric child under the age of 14 months. While the invention as described below is primarily directed to a newborn child, the invention is not limited to a child and can be appropriately sized to support the head and neck of an adult as well. The novel aspects of the pediatric headrest assembly 10 provide for the head and neck of the child to be supported comfortably in a supine position as described in more detail, below. The pediatric headrest assembly 10 includes a hollow support base or frame 20 which is curved in the shape of a circle or oval, or any other desired shape. The support base 20 further includes a support ramp assembly 30 which may be integrally formed with the support base 20. The ramp assembly 30 has a curved end 31 (FIG. 8) for mating engagement to the outer sidewall section of the support base 20 or as a separate unit. As best shown in FIG. 3, the ramp assembly 30 includes an angled surface 32 and is positioned to support the shoulders and upper back of an child. The angle of the angled surface 32 is in the range of about 10 to about 45 degrees with respect to a horizontal plane, and more preferably in the range of about 20 to about 25 degrees. The angled surface 32 is further contoured in order to keep the child's back and shoulder's centered on the ramp 32.

The support base 20 is configured to support a cradle 40 which is positioned and shaped for receiving and supporting an child's head and neck. The cradle 40 includes a curved neck support section 42 and a curved head support section 44. It is preferred that the head support section 44 be slightly inclined with respect to the neck support section 42, on the order of about 3 to about 5 degrees. The neck support section 42 has been designed to receive and support the neck of an child or pediatric child. For example, for a child under six months of age, the radius $R_1$ (FIG. 4) of the neck section may be in the range of about 2.75 to about 4 inches, and more preferably about 3.75 inches. The head support section 44 has been designed to cup and support the rear section of the head of an child or pediatric child, and is preferably shaped to conform to the head of the average size child. For example for an child under six months of age, the radius $R_2$ may be in the range of about 3.5 to about 7 inches. The curved surfaces of the headrest assembly 10 ensure that the child does not develop flat spots or other deformations of the cranium (positional plagiocephaly). The head support section 40 further includes curved tangential sidewalls 46 with a wing shaped upper section 48 on each side. It is preferred that the sidewalls 46 of the lower or front section have a low profile or reduced height so that the sidewall does not interfere with the child's breathing. The wing shaped upper sections 48 are positioned to be in the vicinity of the rear surface of the child's head and are designed to assist in the cupping and supporting of the rear portion of the child's head in order to prevent the child from turning over on its stomach.

The cradle 40 is mounted to the support base 20 via mounting flanges 50 which extend down from the under surface of the cradle 40 and which have aligned holes for receiving pins 54 which extend from either side of a support rail 56. The support rail 56 is mounted within support hubs 60 mounted in an interior wall 22 of the support base 20. The support hubs 60 may optionally be spring loaded to add compliance to the cradle 40.

Figure 5:
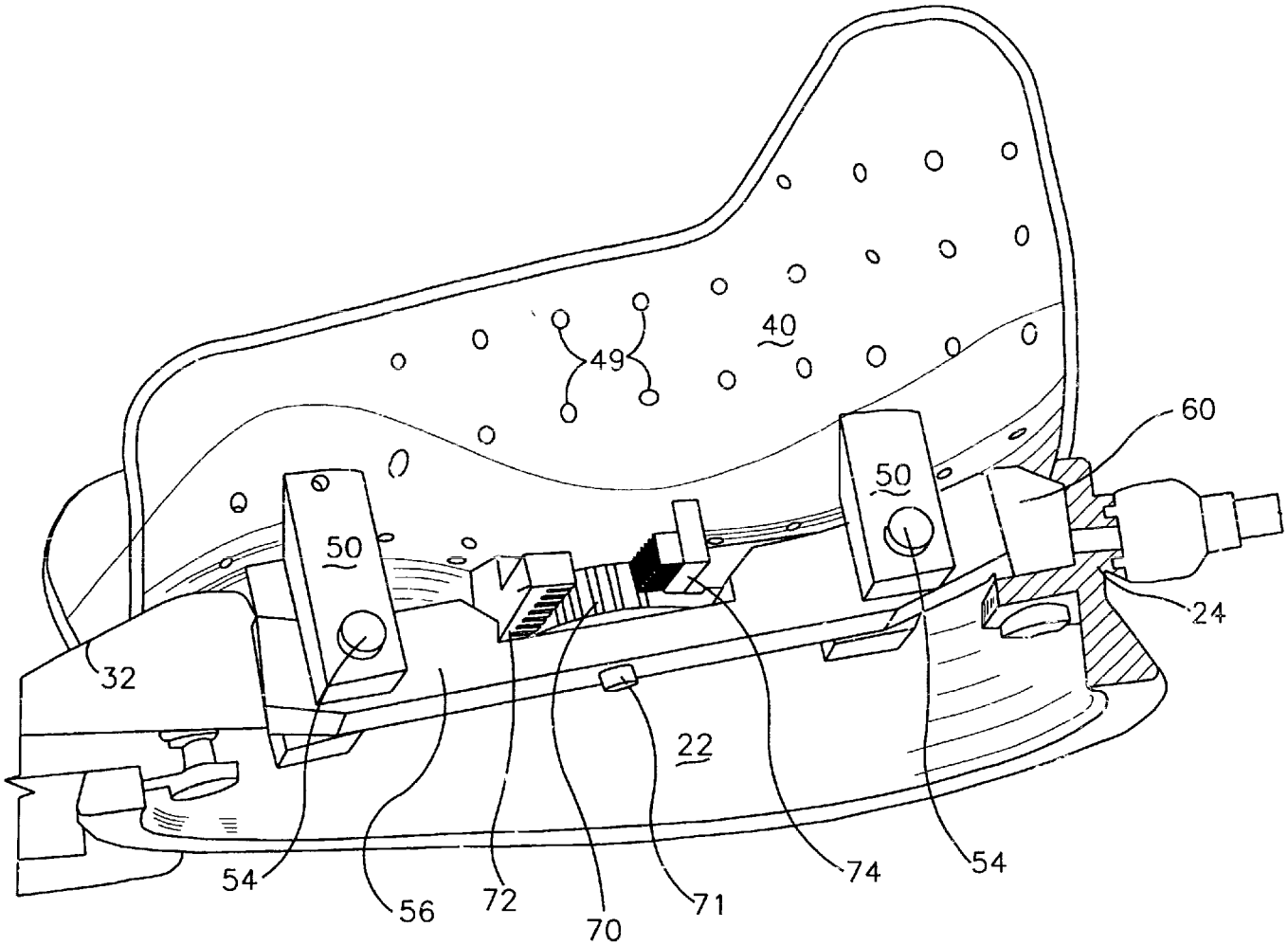
FIG. 5 is a side elevational view of the pediatric headrest of FIG. 1 shown with a portion of the support base removed.
Figure 6:
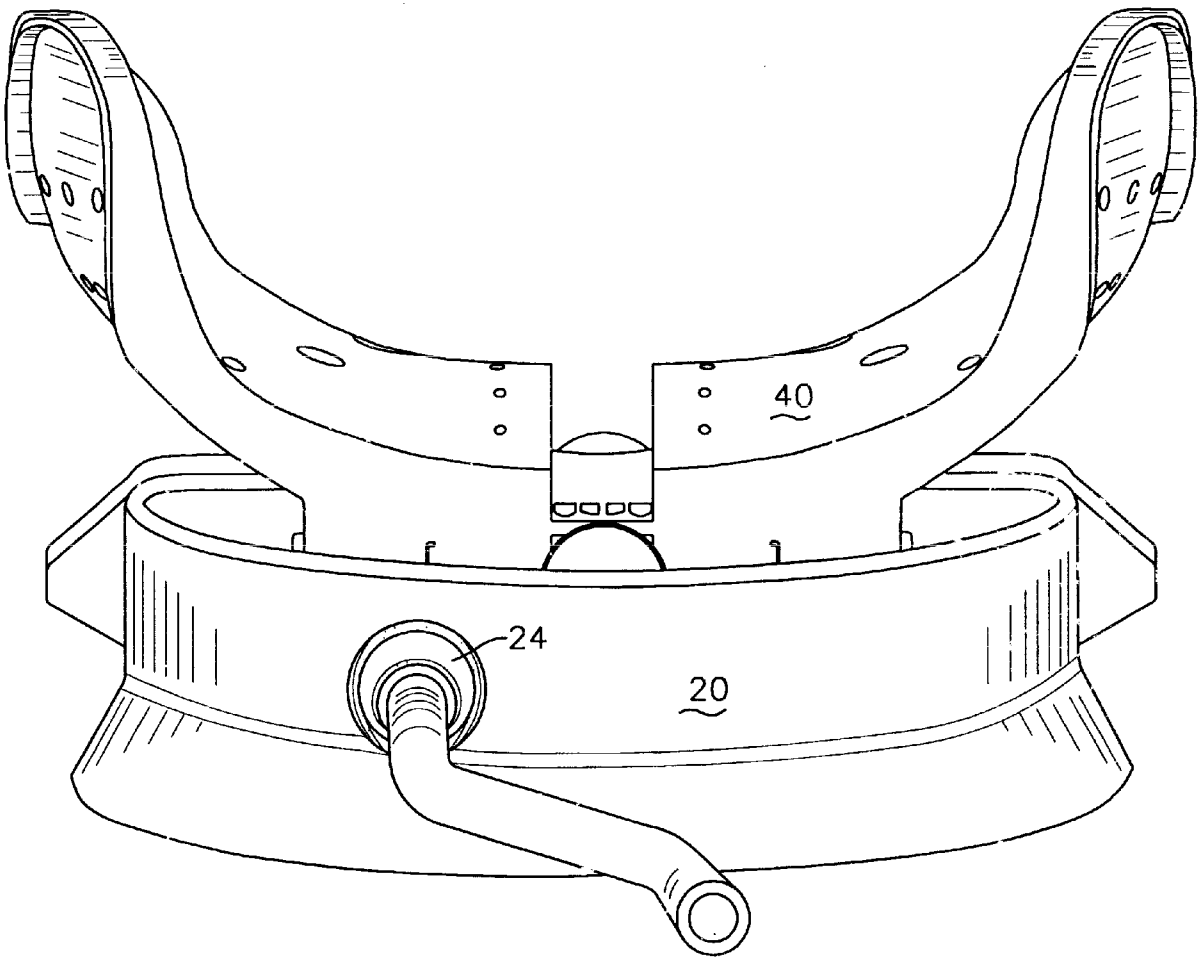
FIG. 6 is a rear elevational view of the pediatric headrest of the invention as shown in FIG. 1.
Figure 7:
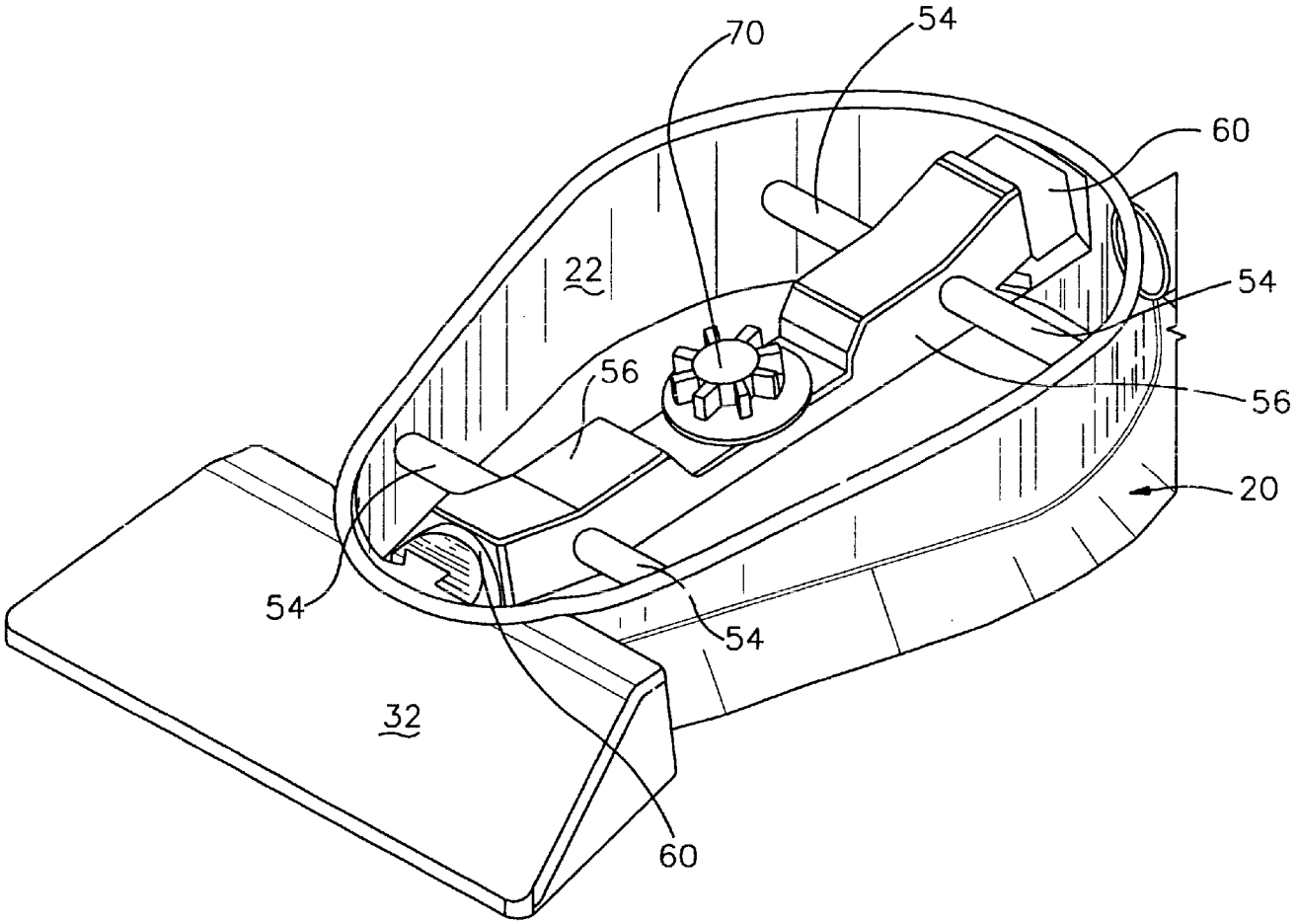
FIG. 7 is a perspective view of the support base and ramp assembly of the pediatric headrest shown with the cradle removed.
Figure 8:
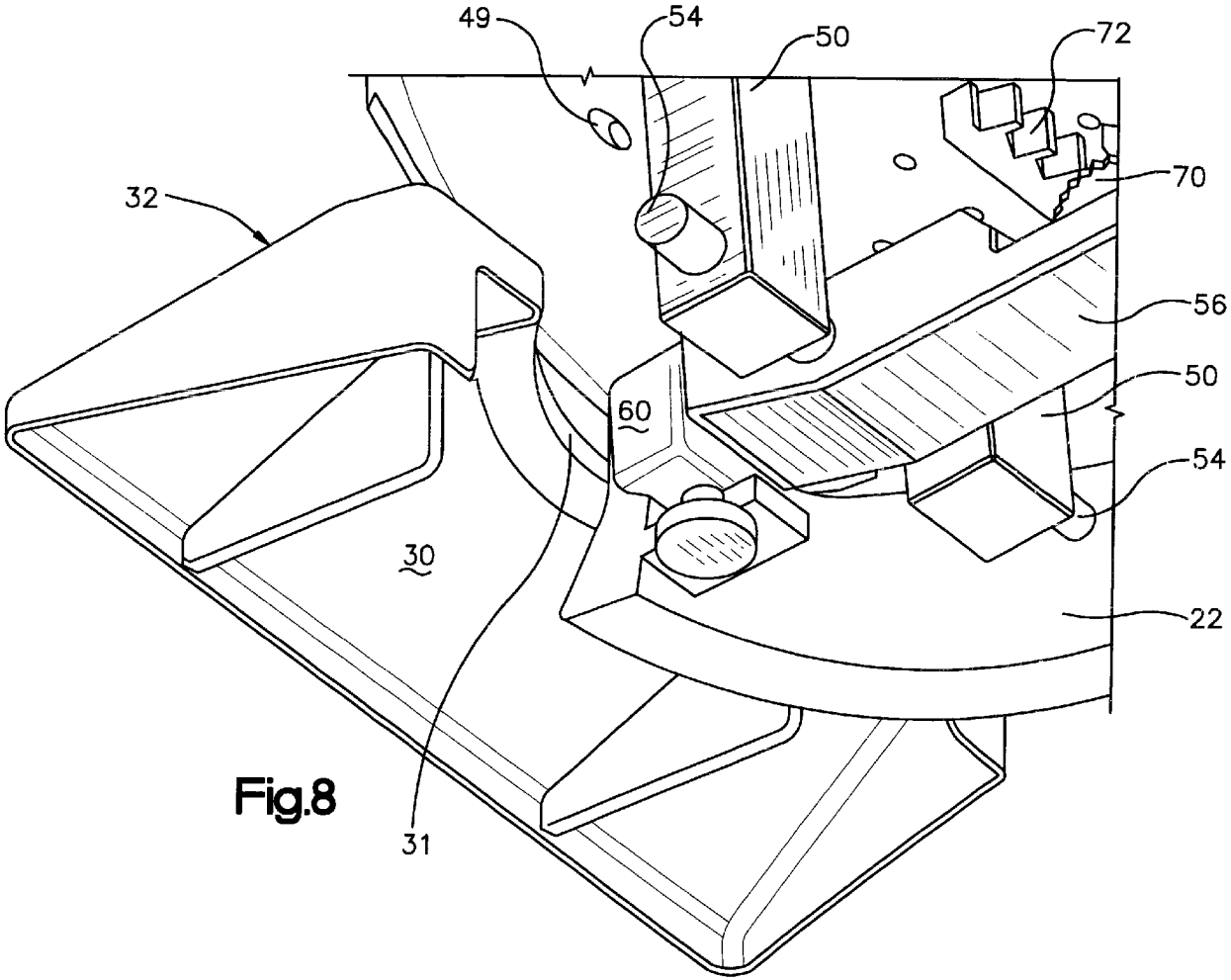
FIG. 8 is a perspective view of a portion of the underside of the support base.
Figures 12A, 12B:
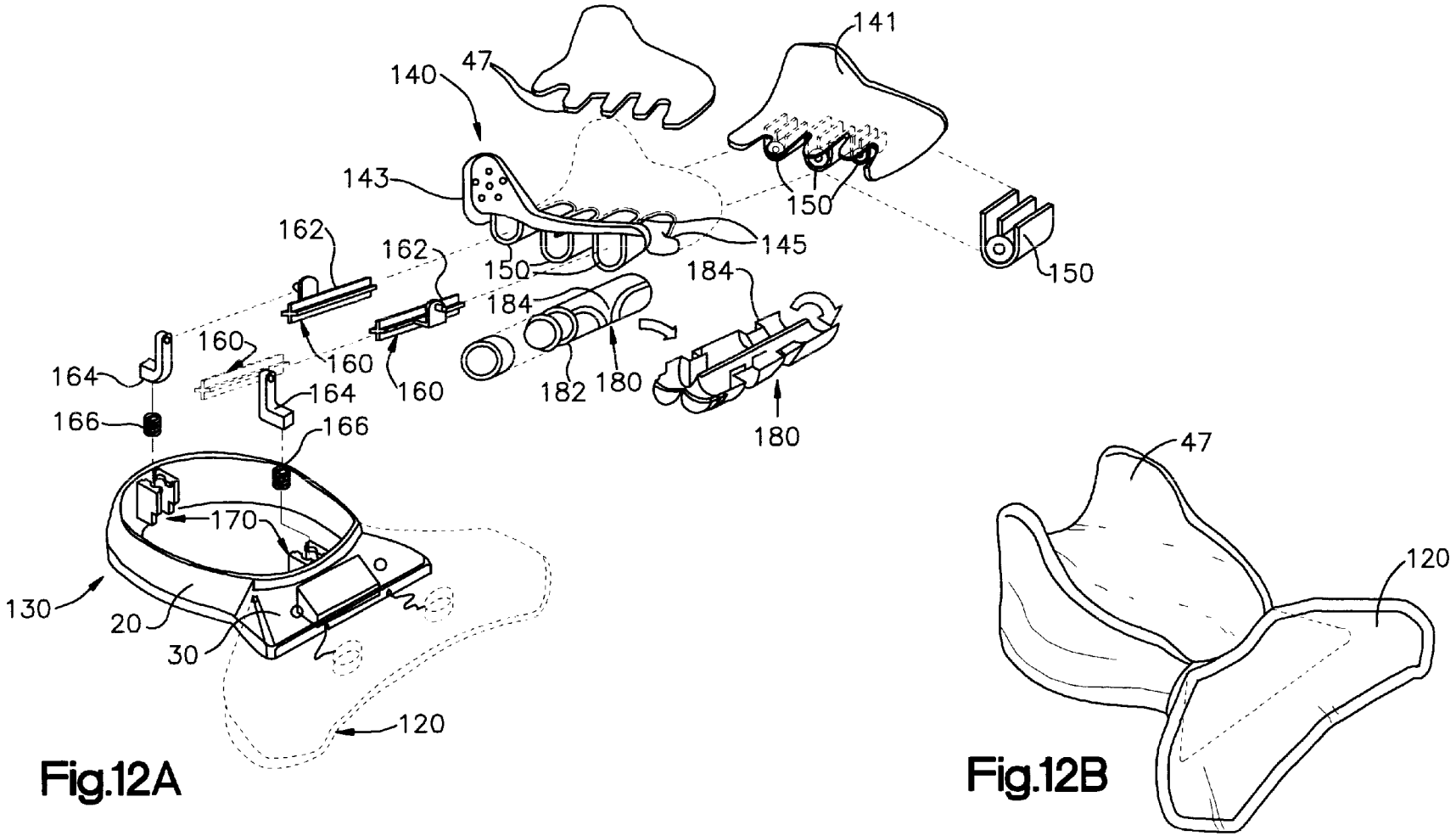
FIGS. 12A and 12B are explosive and perspective view of another embodiment of the pediatric headrest assembly.

The pediatric headrest assembly 10 as described above may optionally comprise a cradle divided in two halves with a seam down the centerline or longitudinal axis of the cradle. Each half of the cradle may be slidably mounted upon the pins 54, so that each half may slid upon the pins in the direction away from the opposite half in order to increase the width of the headrest as the child grows. It is preferred that the seam formed by each half of the cradle be zigzagged to form fingered edges such as shown in FIG. 12A, in order to avoid an abrupt discontinuity of the cradle. As shown in FIGS. 5 and 7, a gear 70 is mounted upon the support rail 56 and has gear teeth positioned for mating engagement with teeth of racks 72 and 74 located upon each half of the cradle 40. Thus in order to enlarge the cradle 40, the knob 71 of gear 70 is rotated by a user, so that the gear teeth engage the teeth of racks 72, 74 resulting in the translation of each cradle half away from each other until the desired width is reached. Once the desired position is reached, detents or setscrews (not shown) may be used to secure the position of the mounting flange 50 on the pins 54. This ability to expand the width of the headrest assembly 10 allows the device to adapt to the changing anatomy of a growing child.

It is preferred that the surface of the cradle 40 comprise a plurality of closely spaced holes 49 which provide an increase of air circulation to the child. The pediatric headrest assembly 10 may additionally comprise an air/oxygen port 24 within the support base 20 for supplying dry heated or humidified air or oxygen to the vicinity of the cradle 40. The support base 20 may function as an air/oxygen manifold so that the fluid percolates up through the surface of the cradle. Thus it is desired that the oxygen or air port be positioned so that the desired humidified air, medicated air or oxygen percolates up through the holes 49 in the cradle 40 to the child.

The headrest assembly 10 may optionally comprise a motion sensor (not shown) such as for example, the impedance type or piezoelectric crystal type which can be mounted within the cradle or preferably the ramp assembly 30 in order to sense when the child stops moving or breathing. The motion sensor may be connected to an alarm system to trigger an audible alarm if the child stops moving for a set period of time. The headrest assembly 10 may further comprise a pulse meter in the ramp assembly 30 to be located adjacent the child's carotid artery or near the heart in order to monitor the cardiac electrical signal.

The cradle 40 may be comprised of a polymeric or other rigid material, but it is preferably comprised of a plastic material covered by a layer 47 of soft porous or foam material. The foam material may be high or low density, but it is preferably a closed cell foam material that is resistant to bacteria and fluid penetration. It is additionally preferred that the foam layer 47 be covered with a removable, washable and breathable fabric such as GORETEX, porous nylon or terry cloth. The ramp assembly 30 may be made of plastic or other rigid material and coated with a soft conformable porous material such as foam. However, the ramp assembly 30 may be entirely comprised of a soft compressible material such as high or low density foam. The ramp assembly 30 is more preferably covered with a washable and removable liner.

Figure 9:
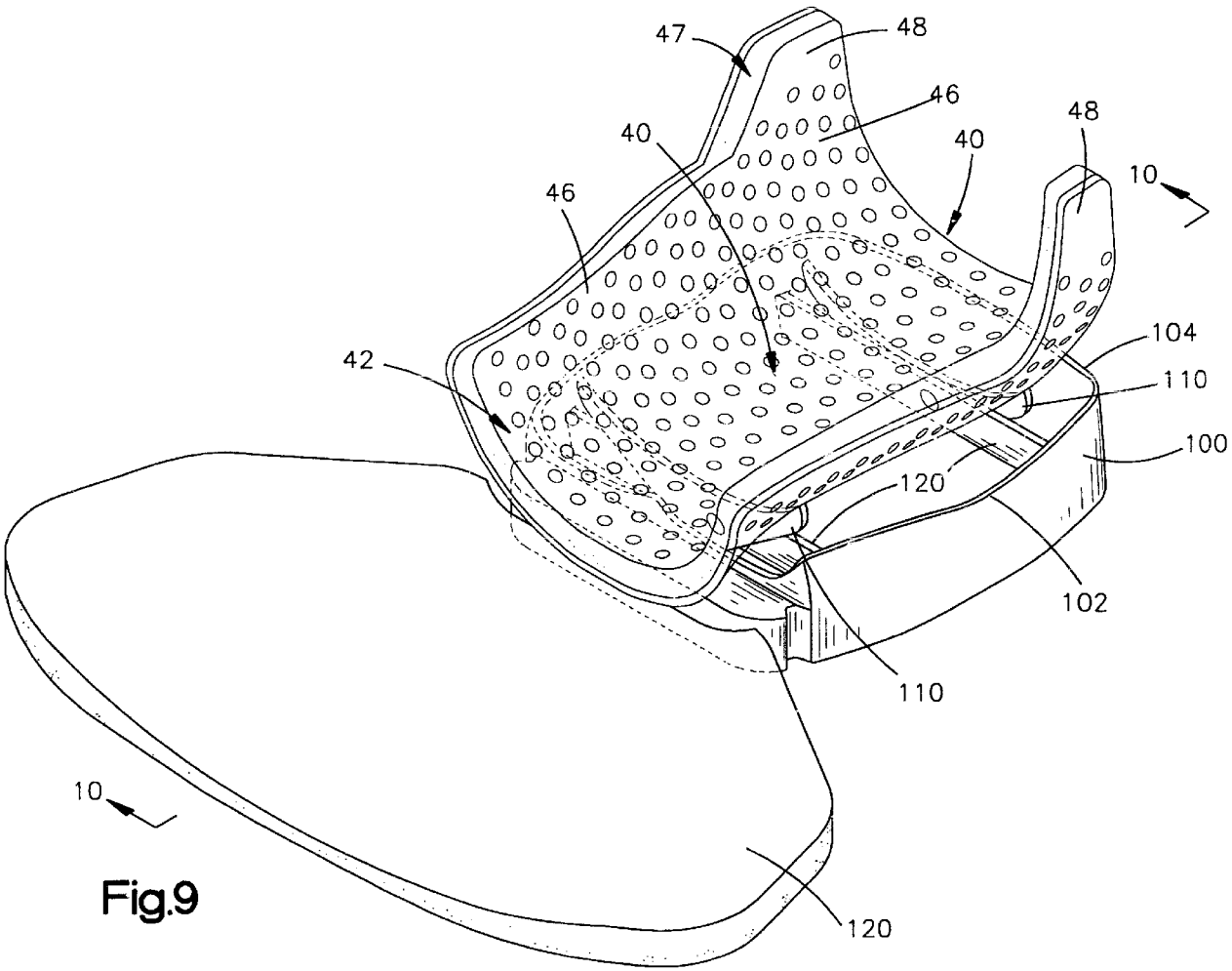
FIG. 9 is a perspective view of an alternate embodiment of the pediatric headrest assembly.
Figure 10:
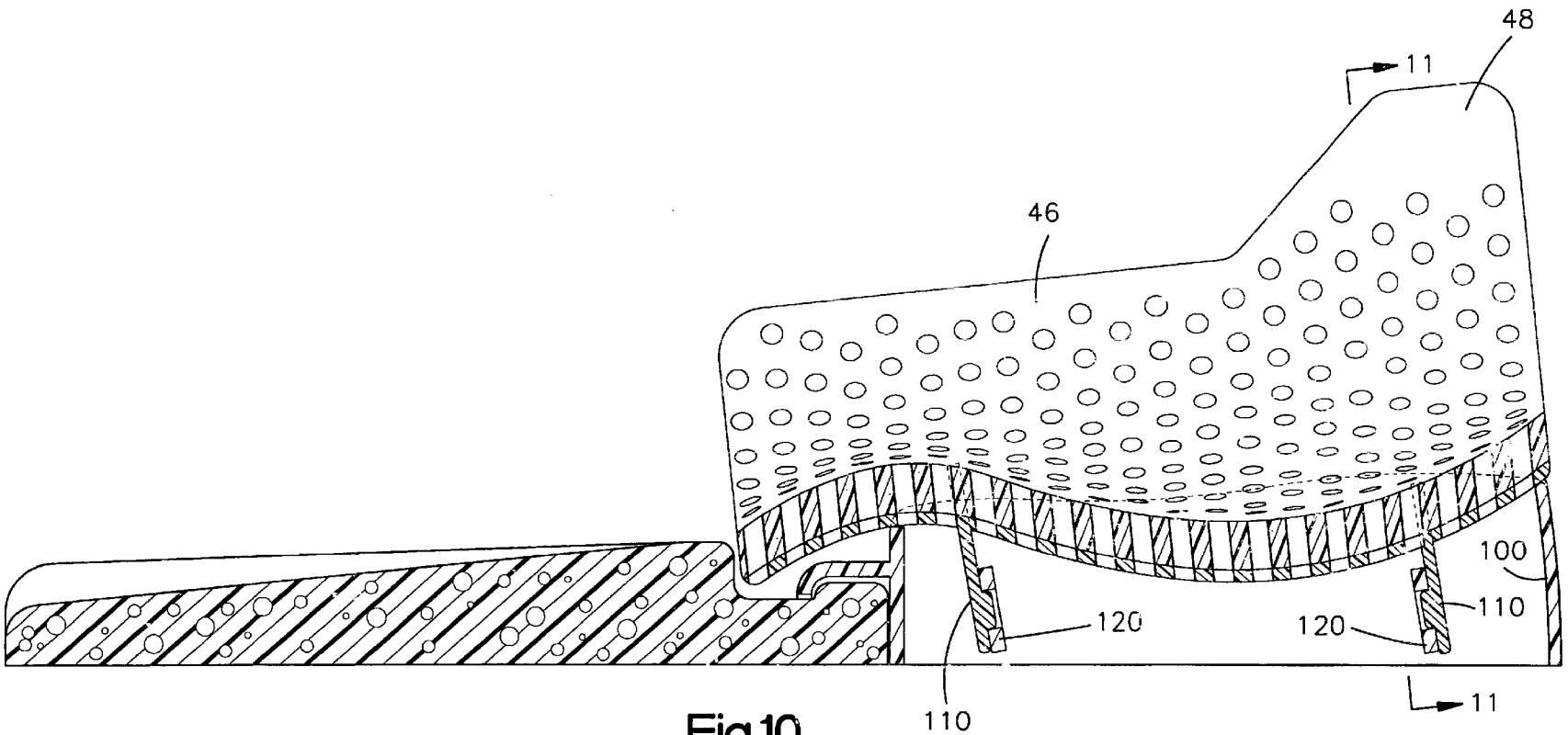
FIG. 10 is a cross-sectional view of the pediatric headrest assembly in the direction 10—10 as shown in FIG. 9.
Figure 11:
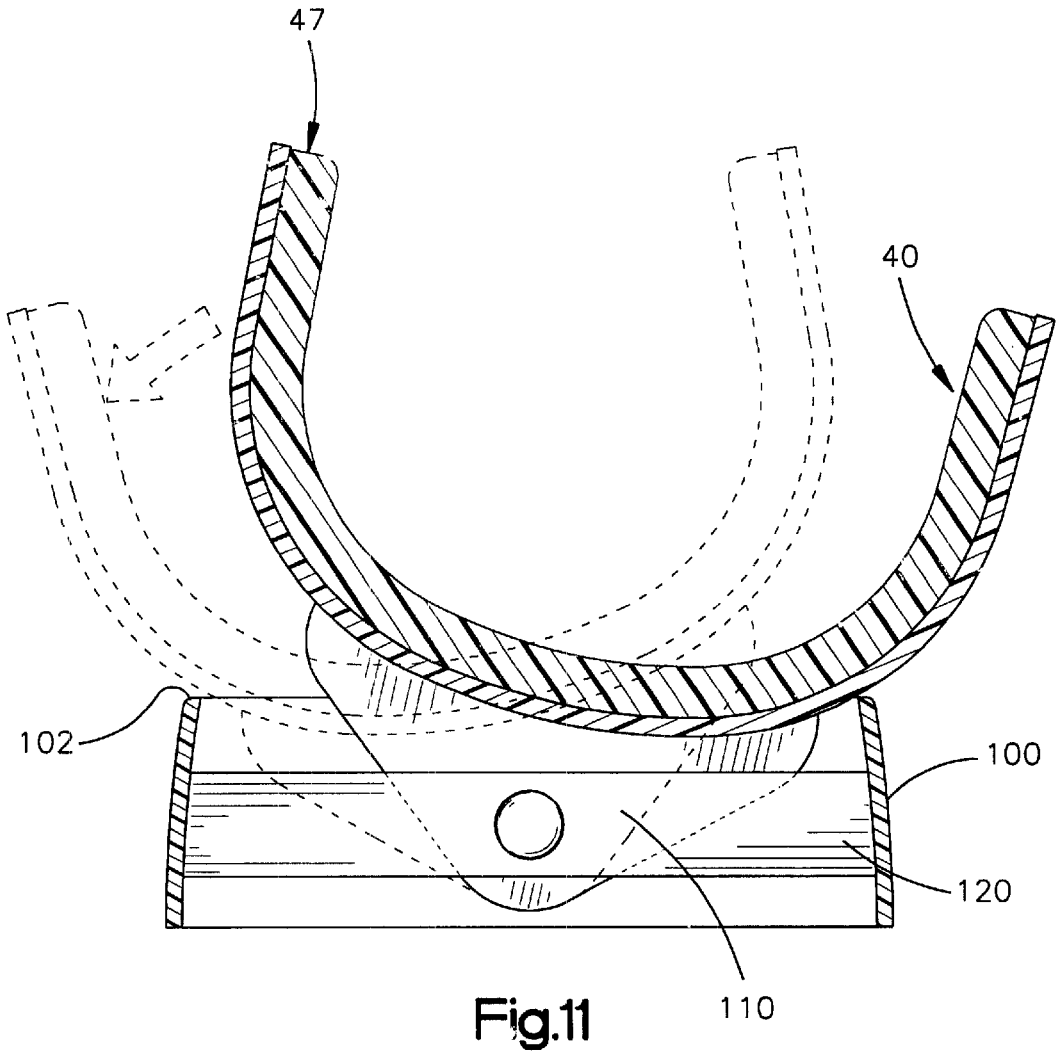
FIG. 11 is a cross sectional view in the direction 11—11 of FIG. 10.

An alternate embodiment of the pediatric headrest assembly is shown in FIGS. 9 through 11. In this embodiment, the cradle 40 is pivotally mounted upon modified support base 100 so that the cradle may tilt from side to side. The cradle 40 is mounted to the support base 100 via one or more triangular shaped mounting flanges 110 which are pivotally connected to load support bars 120. The load support bars 120 are transversely mounted to the interior of the support base 100. The edges of sidewalls 102, 104 are shaped to act as a mechanical stop so that the amount of tilt or rocking of the cradle 40 is controlled. It is preferred that the angle of tilt be in the range of about 15 degrees to 30 degrees from a vertical axis.

The cradle 40 is shaped as described above, and includes a thin outer plastic shell with preferably a plurality of closely spaced holes. The cradle 40 further comprises a removable layer of soft compressible material which can be made of varying thickness. Thus, the compressible material layer may be varied in thickness in order to adjust the width of the cradle as a child's anatomy increases. It is preferred that the compressible material also comprise a plurality of spaced holes which are aligned with the holes of the outer plastic shell.

The shoulder support 120 of this embodiment comprises a contoured layer of soft compressible material which is preferably angled in the range of about 5 to about 15 degrees. The material is preferably closed cell foam or open cell urethane. It is additionally preferable that the material be capable of being formed into shapes or compression molded and have an outer layer which resists bacteria and the absorption of liquids.

Another alternate embodiment of the pediatric headrest assembly 130 is shown in FIGS. 12A and 12B. The cradle 140 is shown as a right half 141 and a left half 143 with the seam edge having interleaving fingers 145. Each cradle half 141, 143 may comprise a soft compressible liner 47 comprised of foam or other soft material as described above. On the underside of each cradle half 141, 143, are three aligned transverse channels 150. A cradle suspender 160 is slidably received within the two outer channels 150 of each cradle half 141, 143 so that each cradle half may slide upon guides 162 of the suspenders 160 in order to adjust the width of the assembled cradle. Each cradle suspender 160 is affixed to L shaped cradle mounts 164 which are received within aligned slots 170 of the support housing 20. Optional springs 166 may be received within the slots 170 in order to provide compliance to the cradle assembly 130. Positioned for reception in the middle aligned channels 150 of each cradle half 141, 143, 145 is adjustment pin 180. The adjustment pin 180 has a threaded end 182 for being secured within a hole of a channel wall (not shown) of one of the cradle halves. The opposite cradle half has a pin (not shown) within the interior of the channel wall and which tracks within a groove 184 of the adjustment pin 180 as it is rotated. The groove 184 is shaped like a spiral or helix about the adjustment pin 180. In order to adjust the width of the cradle assembly, the adjustment pin 180 is rotated so that the pin tracks within the groove 184 and increases or decreases the width of the cradle 140.

Figure 13B:
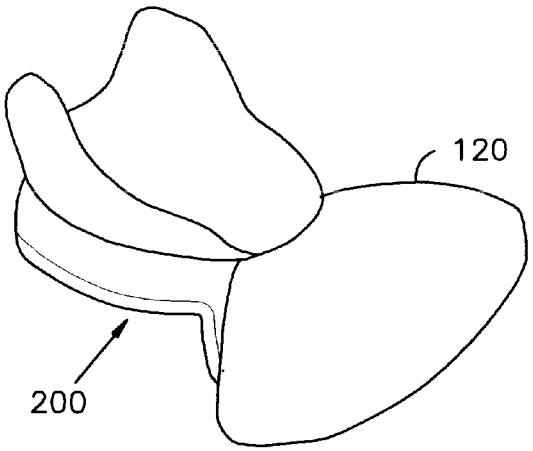
FIGS. 13A and 13B are explosive and perspective views of yet another embodiment of an adjustable pediatric headrest assembly.
Figure 13A:
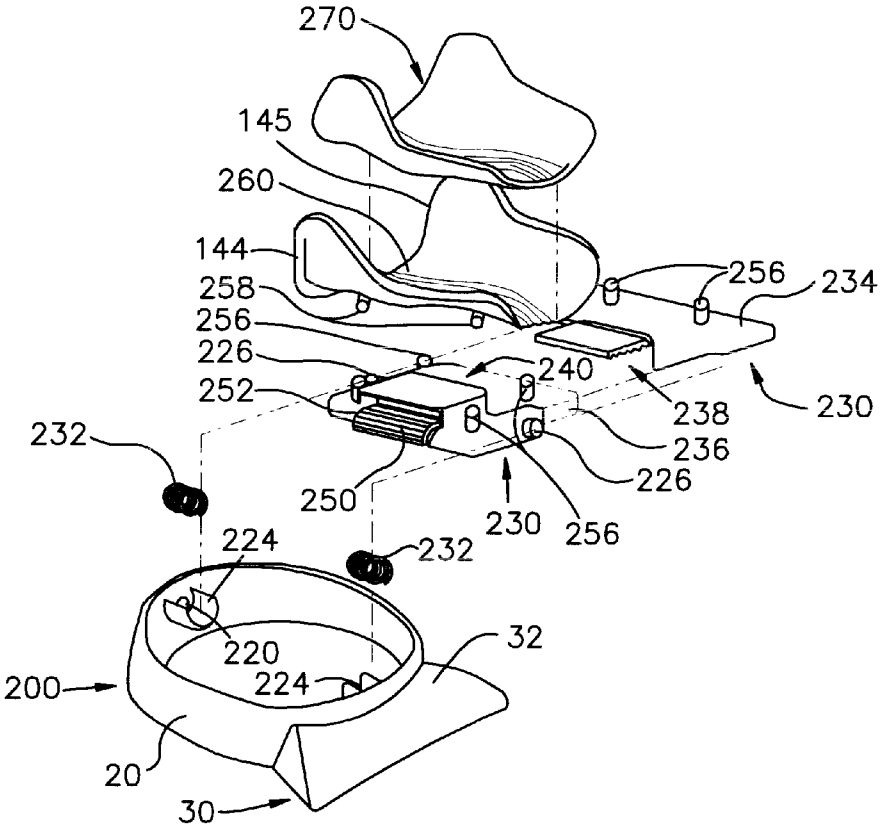

Yet another embodiment of the adjustable pediatric headrest assembly 200 is shown in FIGS. 13A and 13B. The support base 20 includes opposed recessed holes 220 located on the base longitudinal axis. Located about the holes 220 are semicircular flanges 224 for supporting the mounting rods 226 of a cradle support 230. Springs 232 may be optionally included and located within the recessed holes 220 for resilience of the cradle. The cradle support 230 is formed of a mating right 234 and left half 236, with the left half 236 being stationary and mounted within the cradle support 230. The right half 234 has a grooved tongue 238 which is aligned for reception in a slot 240. Grooves of tongue 238 are positioned for mating engagement with teeth 252 of L shaped clip 250. The end of clip 250 protrudes through an open end of the slot 240 so that a user may press down on the clip 250 to disengage the teeth 252 of the clip 250 with the tongue grooves in order to adjust the width of the cradle support. Extending up from each half of the cradle support 230 are a plurality of mounting sleeves 256 aligned for reception of the mounting plugs 258 located on the underside of the cradle. The cradle 144, 145 may be integrally molded with a middle section 260 formed of molded expansion pleats to allow the width of the cradle to expand or contract. The cradle 144, 145 may additionally comprise a right and left half with interleaved fingers as described above, or a right half, a left half and a pleated expansion section. The cradle may be comprised of a flexible plastic or other material with a plurality of holes as described above, and may further comprise a breathable foam outer layer 270 that has molded pleats to allow for expansion. In order to adjust the width of the headrest assembly, the cradle plugs 258 are removed from their mounting sleeves 256, and the L shaped clip 250 is pressed down to disengage the clip teeth 252 from the grooved tongue 238. The tongue 238 may then be slid in or out to the desired location. Once the desired width is achieved, the clip 250 is released so that the clip teeth may engage with the grooves of the tongue 238. The cradle 143, 145 may then be mounted onto the cradle support 230.

Figure 14B:
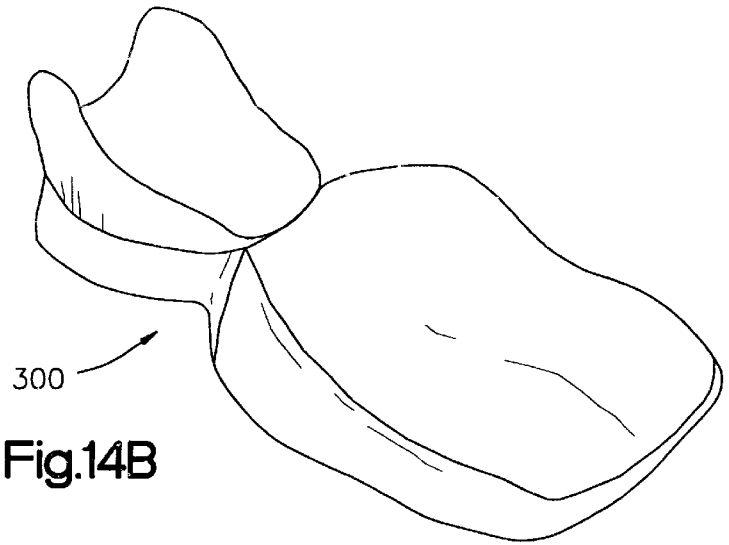
FIGS. 14A and 14B are explosive and perspective views of still another embodiment of an adjustable pediatric headrest assembly.
Figure 14A:
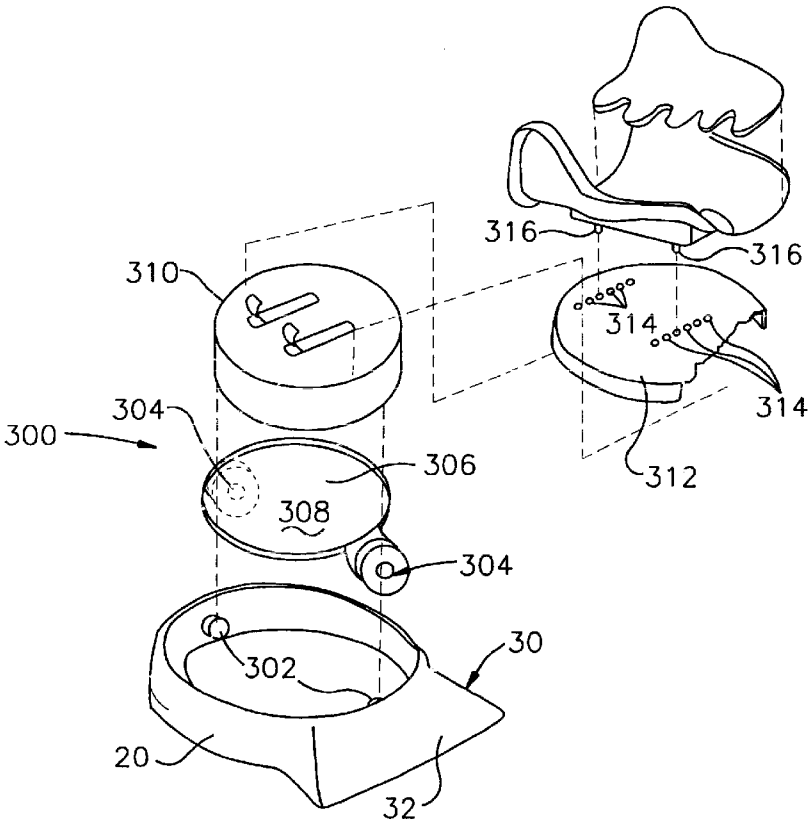

Yet another alternate embodiment of a pivotable headrest assembly 300 is shown in FIGS. 14A–B. The support base 20 is as described above, except for the mounting details as described below. Located on the interior surface of the support base 20 are opposed mounting pins 302 for reception into recessed holes 304 of pivot platform 306 which is comprised of plastic or other rigid material. On the upper surface 308 of pivot platform 306 is a support cushion 310 made of a soft compressible material which is glued or affixed to the surface 308 by conventional means in order to add resilience to the cradle assembly. A rigid cradle platform 312 is attached to the support cushion 310 by glue, VELCRO or other conventional means and has a plurality of incrementally spaced adjustment holes 314 aligned for receiving the mounting plugs 316 of the cradle 40. The cradle 40 may be integrally formed of various sizes so that as the child grows, the cradle 40 may be exchanged for a larger size. Alternatively, the cradle may comprise a right half 145 and left half 144 as described above, with each half having mounting plugs 316 which snap into the holes.

Figure 15B:
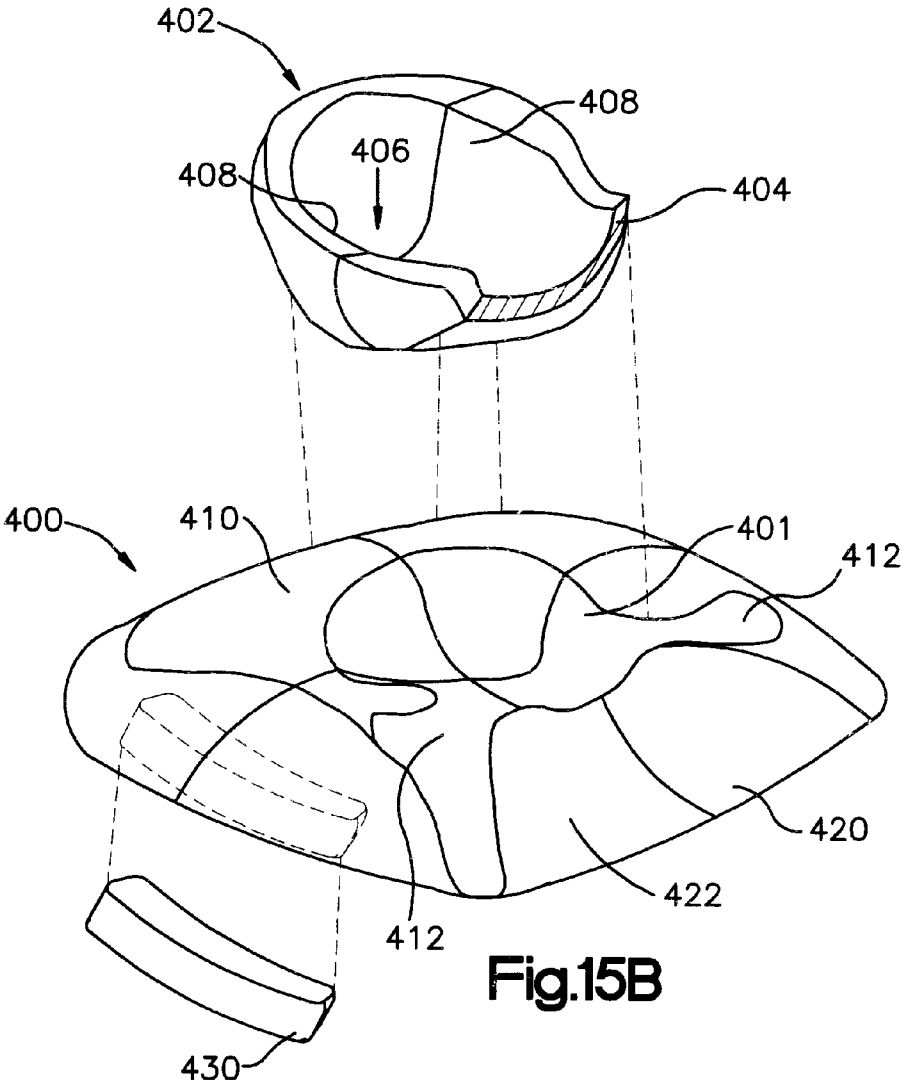
FIGS. 15A and 15B are top and explosive view of still another embodiment of a low profile pediatric headrest assembly.
Figure 15A:
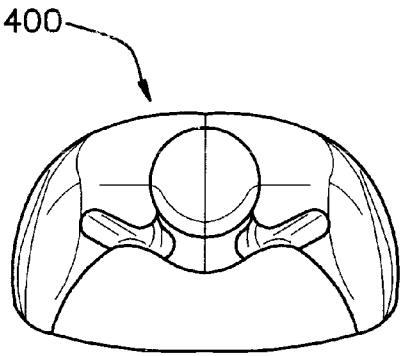

In still another embodiment of the invention as shown in FIGS. 15A and 15B, the pediatric headrest assembly 400 may be comprised entirely of a combination of soft compressible materials of varying density for providing support in the neck and cranial region. The headrest assembly 400 comprises a pillow section 410 which has a recessed portion 401 configured to receive an integrally molded cradle insert section 402 therein. The cradle insert 402 preferably has a higher density or stiffness than the pillow section 410. The cradle insert 402 may be perforated to provide for increased ventilation to the child's head. The cradle insert 402 includes a neck support section 404 and a head support section 406. It is preferred that the head support section 406 be slightly inclined with respect to the neck support section 404, on the order of about 3 to about 5 degrees. The neck support section 404 has been designed to receive and support the neck of an child or pediatric child. The head support section 406 has been designed to cup and support the rear section of the head of an child or pediatric child, and is preferably shaped to conform to the head of the average size child. The curved surfaces of the headrest assembly 400 ensure that the child does not develop flat spots or other deformations of the cranium. The head support section 406 further includes curved tangential sidewalls 408. It is preferred that the sidewalls 408 of the lower or front section have a low profile or reduced height so that the sidewalls do not interfere with the child's breathing. The shaping of the head and neck support sections 401 and 406 have been designed to assist in the cupping and supporting of the child's rear portion of the head in order to prevent the child from turning over on its stomach.

The cradle insert 402 may be made of varying sizes and is designed to be removably received within the recessed portion of the pillow section 410. The cradle insert 402 may be removably affixed to the recessed portion via conventional means such as snaps or VELCRO like fasteners. In order to assist in removal of the cradle insert 402 form the pillow section 410, recessed openings 412 (FIG. 15B) are provided.

The pillow section 410 of the headrest assembly further comprises a shoulder support section 420 which preferably has an inclined surface 422 designed to center and support the shoulders and upper back of a child. The pillow section 410 may further optionally comprise inserts 430 for reception into slots (not numbered) located on the underside of the pillow section 410. The inserts 430 may comprise a rigid material or higher density material so that the inserts add structural support to the assembly 400.

It is preferred that the materials of the pillow section 410 and the cradle insert 402 comprise a soft closed cell foam or compressible material which is capable of being formed or molded into shapes such as high performance polyolefin. The assembly may be formed of a combination of materials having different densities in order to achieve the desired support of the head and neck. It is additionally preferred that the material resist bacteria and the absorption of liquids and have a closed cell construction.

Figure 16A:
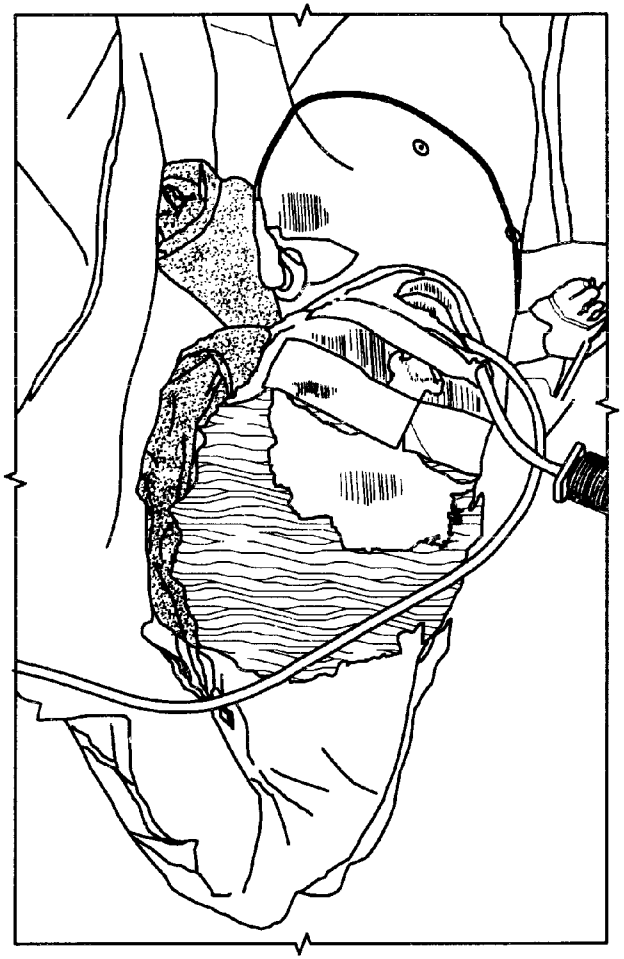
Fig.16A (PRIOR ART)
FIGS. 16A and 16B are perspective views of a prior art pediatric headrest and the pediatric headrest of the invention shown in use in surgery, respectively.
Figure 16B:
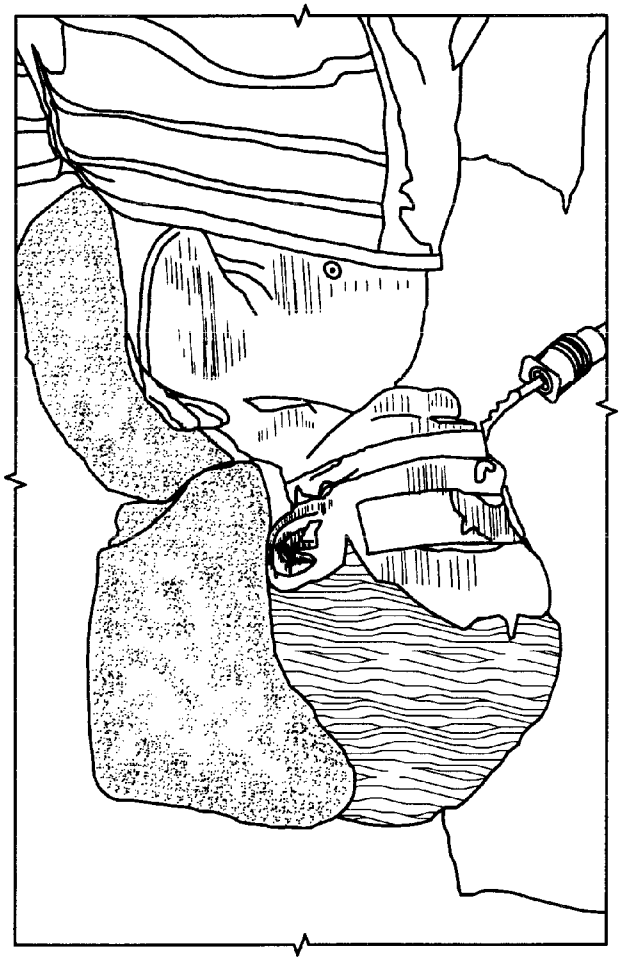

All of the above described pediatric headrest assemblies are portable and adaptable for use in a crib, bed, stroller or other flat surface. Additionally, the headrest assemblies may be adaptable for use in a car seat. The pediatric headrest assemblies may also be utilized in a medical setting as a surgical headrest for use in an operating room as shown in FIG. 16B. As shown in FIG. 16A, the prior art surgical head rests comprise surgical towels which have been shaped to form a support.

Although the invention has been disclosed and described with respect to certain preferred embodiments, certain variations and modifications may occur to those skilled in the art upon reading this specification. Any such variations and modifications are within the purview of the invention notwithstanding the defining limitations of the accompanying claims and equivalents thereof.

We claim:

1. An apparatus (10/120/130/200/300) for supporting the neck and head of a child, said apparatus (10/120/130/200/300) comprising:

a base (20/100); and a cradle (40/140) supported by said base (20/100), said cradle (40/140) having a first support section (42) that is contoured to support the neck of the child and a second support section (44) that is contoured to support the head of the child;

said second support section (44) including an oppositely disposed pair of tangentially extending sidewalls (46) that have a curved shape for cupping the head of the child, said sidewails (46) having a reduced height so as not to interfere with the child's breathing through its nose or mouth;

each of said sidewalls (46) having a wing-shaped upper section (48) that projects upward from each of said sidewalls, said upper sections (48) of said sidewalls (46) assisting in the cupping and supporting of the child's head and helping to prevent the child from turning over onto its stomach wherein said cradle (40/140) is divided into relatively movable first and second cradle halves (141 and 143, 144 and 145) that are separated by a seam, each of said cradle halves (141 and 143, 144 and 145) including a portion of said first support section (42) and a portion of said second support section (44), said first and second cradle halves (141 and 143, 144 and 145) being relatively movable toward or away from each other to accommodate different sizes of child's heads and allow for growth of a child's head.

2. The apparatus (10) of claim 1 further comprising a rotatable gear (70) and at least one rack (72, 74) having teeth engaged with said gear, said gear (70) being supported for rotation by said base (20), said at least one rack (72, 74) being attached to said first and second cradle halves (141 and 143), wherein relative movement of said first and second cradle halves (141 and 143) is caused by rotation of said gear (70).

3. The apparatus (10/130) of claim 1 wherein said seam separating said first and second cradle halves (141 and 143) has a zigzag configuration formed by interleaved fingered edges (145) on said cradle halves.

4. The apparatus (130) of claim 1 further comprising an adjustment pin (180) having a spiral groove (184) and being secured to said first and second cradles halves (141 and 143), wherein relative movement of said first and second cradle halves (141 and 143) is caused by rotation of said adjustment pin (180).

5. The apparatus (200) of claim 1 further comprising a cradle support (230) formed by first and second support halves (234 and 236), said first and second cradle halves (144 and 145) being attached to said first and second support halves (234 and 236), respectively.

6. The apparatus (200) of claim 5 wherein said first support half (234) includes a grooved tongue (238) and second support half (236) includes a slot (240) for slidably receiving said grooved tongue, said second support half (236) further including a movable clip (250) having teeth (252) that engage said grooved tongue.

7. An apparatus for supporting the neck and head of a child, said apparatus comprising:

a base and a cradle supported by said base, said cradle having a first support section that is contoured to support the neck of the child and a second support section that is contoured to support the head of the child;

said second support section including an oppositely disposed pair of tangentially extending sidewalls that have a curved shape for cupping the head of the child, said sidewalls having a reduced height so as not to interfere with the child's breathing through its nose or mouth;

each of said sidewalls having a wing-shaped upper section that projects upward from each of said sidewalls, said upper sections of said sidewalls assisting in the cupping and supporting of the child's head and helping to prevent the child from turning over onto its stomach, the apparatus further comprising a support cushion attached to said base and a cradle platform attached to said support cushion, said first and second support sections of said cradle being mounted to said cradle platform, said cradle including a plurality of mounting plugs that are receivable by plurality of holes in said cradle platform which provide positional adjustment of said cradle relative to said cradle platform.

8. An apparatus for supporting the neck and head of a child, said apparatus comprising:

a base; and a cradle supported by said base, said cradle having a first support section that is contoured to support the neck of the child and a second support section that is contoured to support the head of the child;

said second support section including an oppositely disposed pair of tangentially extending sidewalls that have a curved shape for cupping the head of the child, said sidewalls having a reduced height so as not to interfere with child's breathing through its nose or mouth;

each of said sidewalls having a wing-shaped upper section that projects upward from each of said sidewalls, said upper sections of said sidewalls assisting in the cupping and supporting of the child's head and helping to prevent the child from turning over onto its stomach, said cradle including a plurality of holes providing increased air circulation around the head of the child.

9. The apparatus (10) of claim 8 wherein said base (20) includes a fluid port (24) for connecting to a fluid supply, said base (20) functioning as a fluid manifold to distribute fluid from the fluid supply into said cradle (40) through said plurality of holes (49).

* * * * *